US005894623A

United States Patent [19]

Thill

[11] Patent Number: 5,894,623

[45] Date of Patent: Apr. 20, 1999

[54] DISPOSABLE LINT REMOVER

[76] Inventor: Anthony J. Thill, 7905 W. 131st Pl., Overland Park, Kans. 66213

[21] Appl. No.: 08/910,654

[22] Filed: Aug. 13, 1997

[51] Int. Cl.[6] ..... A47L 25/08

[52] U.S. Cl. ..... 15/104.002; 15/209.1; 15/227; 134/6

[58] Field of Search ..... 15/104.002, 209.1, 15/210.1, 227; 134/6

[56] References Cited

U.S. PATENT DOCUMENTS

| | | | |
|---|---|---|---|
| 1,785,512 | 12/1930 | Buttenheim . | |
| 2,702,913 | 11/1955 | Krasno . | |
| 2,913,745 | 11/1959 | Welvang . | |
| 3,029,453 | 4/1962 | Norman . | |
| 3,056,154 | 10/1962 | Neal | 15/104.002 |
| 3,151,346 | 10/1964 | Gray | 15/227 |
| 3,231,918 | 2/1966 | Marks . | |
| 3,321,790 | 5/1967 | Hand | 15/227 |
| 3,336,616 | 8/1967 | Martin . | |
| 3,389,416 | 6/1968 | Timms . | |
| 4,713,274 | 12/1987 | Minor | 15/104.002 |
| 4,820,558 | 4/1989 | Sundberg . | |
| 4,934,010 | 6/1990 | Tarlton . | |
| 5,036,561 | 8/1991 | Calafut . | |
| 5,636,406 | 6/1997 | Strong | 15/227 |
| 5,742,969 | 4/1998 | Thomas et al. | 15/104.002 |

*Primary Examiner*—Terrence R. Till
*Attorney, Agent, or Firm*—Shook, Hardy & Bacon L.L.P.

[57] ABSTRACT

A lint removal device with an adhesive side has a pair of spaced apart apertures to receive the fingers of an operator for holding the device while it is brought into contact with a garment or other clothing article to remove particulate matter from the article. When the fingers are inserted through the apertures, the adhesive sticks to the fingers to hold the device securely to the hand. A release liner is provided to protect the adhesive surface during storage and transportation. The lint removal device is also provided in a bulk pad wherein each of the devices is separated by a release liner which has an adhesive strip to hold the devices together in the pad.

19 Claims, 2 Drawing Sheets

DISPOSABLE LINT REMOVER

BACKGROUND OF THE INVENTION

This invention relates to methods and devices for removing lint, dandruff, dirt, ravelings, animal hair, human hair, and other particulate matter from various surfaces and, more particularly, to a disposable hand-held device for removing such particulate matter from articles of clothing and a method for holding the device.

It is well recognized that the majority of fabrics used to make clothing easily pick up lint, hair, and other particulate matter through contact or electrostatic charges created by friction. The accumulation of particles on garments creates a soiled or worn appearance such that their presence on the garments is undesirable. Dry cleaning easily removes particles and gives clothes a fresh, clean appearance, but because of wear on garments and the relatively high monetary cost, it is not desirable to have garments dry cleaned merely to remove lint or other particles. Thus, garments are often brushed with a lint removing brush, or contacted with an adhesive to remove the particles in between dry cleanings.

Over the years, many devices have been created to remove particulate matter from clothing. U.S. Pat. Nos. 2,702,913; 2,724,847; 2,913,745; 3,029,453; 3,056,154; 3,231,918; and 4,820,558 all disclose devices which utilize an adhesive to remove lint. These devices, however, have had certain disadvantages which have limited their use. Specifically, some of these devices have been expensive or complicated to produce. Others have limited availability for use because they are undesirably bulky or cumbersome making it inconvenient for individuals to carry them in a pocket or purse or even a suitcase for maximum availability. Further, the disclosed devices, especially the flat sheets, have failed to provide a convenient and secure way to hold the device during lint removal.

Thus, increasing the portability of adhesive lint removers is desirable to provide maximum availability of lint removers and increasing the ease in which such devices are held during lint removal is desirable to reduce the amount of time necessary to remove lint from garments and make such devices easier to use.

BRIEF SUMMARY OF THE INVENTION

There is, therefore, provided in one embodiment of this invention a novel cleaning device for cleaning particulate matter from articles of cloth. The device, which is disposable and hand-held, utilizes a thin and flexible substrate with a cleaning side surface capable of removing particulate matter from cloth. The device is provided with an aperture extending through the substrate which is sized to receive at least one finger of an operator to hold the device while removing the particulate matter.

In a preferred embodiment the device has two apertures to receive the index and pinky fingers of the operator and is provided with an adhesive cleaning side surface to remove particulate matter. When the fingers are inserted through the apertures, the adhesive sticks to the top of the fingers thereby securing the device to the hand of the operator. Thus the adhesive serves a dual function of releasably securing the lint remover of the invention to the fingers of the user and removing particles from cloth. Preferably, a release liner is provided to protect the adhesive cleaning side surface prior to use. The device is also provided in a bulk pad having a plurality of the devices. The release liners function to separate the substrates and are provided with adhesive strips to attach each release liner to an adjacent release liner.

There is further provided in the practice of the invention a novel method for removing particulate matter from an article of clothing. The method comprises inserting a first finger into the first aperture from a passive side of the lint removal device, inserting a second finger through the second aperture from the passive side and contacting the article of clothing to be cleaned with the adhesive surface. Preferably, the index and pinky fingers of a hand are inserted through the apertures and the adhesive surface sticks to the top, or fingernail sides of the index and pinky fingers. If a release liner is provided it is removed before inserting the fingers into the apertures.

Accordingly, it is an object of the present invention to provide an improved lint removing device which is more easily stored for being carried by a user in a pocket, purse, or suitcase.

It is a further object of the present invention to provide an improved lint removing device which is more conveniently held during lint removal.

BRIEF DESCRIPTION OF THE DRAWINGS

These and other features, advantages, and objects will appear from the following Detailed Description when considered in connection with the accompanying drawings in which similar reference characters denote similar elements throughout the several views and wherein.

DETAILED DESCRIPTION OF THE PREFERRED EMBODIMENTS

Figure 1:
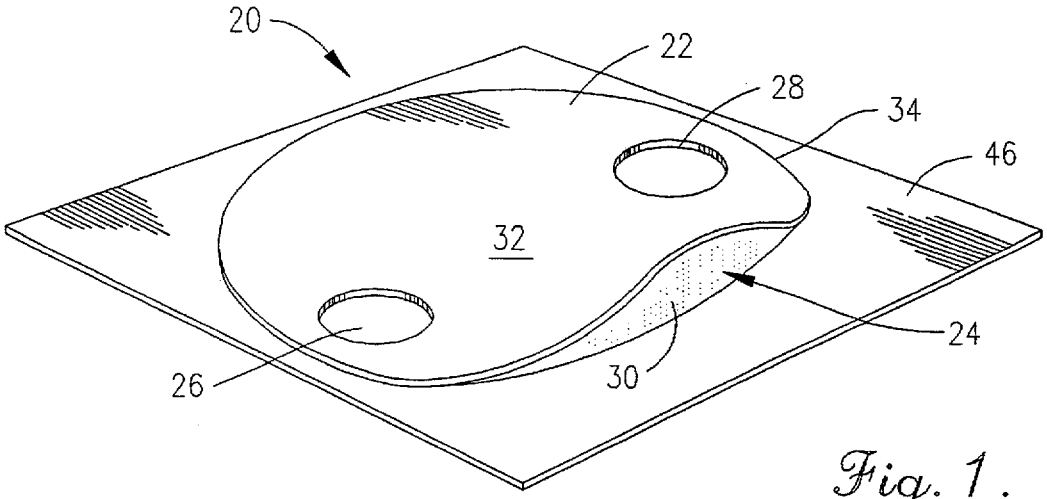
FIG. 1 is a perspective view of a lint removal device in accordance with the present invention.
Figure 2:
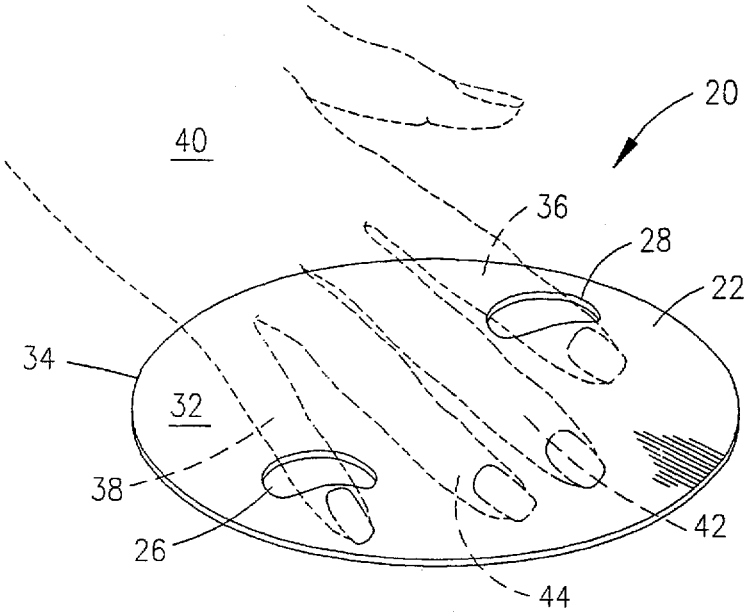
FIG. 2 is a perspective view illustrating the operation of the lint removal device of FIG. 1.

Referring to the drawings in greater detail, FIG. 1 shows a disposable hand-held cleaning device, generally designated 20, for cleaning particulate matter from articles of cloth, specifically garments. The device includes a thin and flexible substrate 22 with a cleaning side 24 capable of removing particulate matter from cloth. The preferred embodiment is provided with a first aperture 26 and a second aperture 28 for receiving fingers of the hand of the operator as illustrated in FIG. 2. While holding the lint removal device as illustrated in FIG. 2, the operator simply brings the cleaning side into contact with the garment to remove lint and other particulate matter from the garment.

The substrate 22 is thin and somewhat flexible, so that it will readily deform to receive fingers into the apertures 26, 28 and to match the contour of a garment. The cleaning side 24 has a cleaning side surface 30 which is preferably adhesive. Opposite the cleaning side 24 is the passive side 32. The passive side 32 is preferably smooth to provide a comfortable engagement with the fingers and palm of the operator's hand. The flexible substrate 22 also has a circumferential edge 34 which is preferably circular in shape and has a diameter of approximately 4 inches when the substrate is laid flat.

The apertures 26, 28 are preferably substantially circular openings sized to receive fingers of the operator. Contrary to conventional practice, the apertures reduce the cleaning side surface area available for removing lint. To counteract this somewhat, the apertures may comprise any shape or even slits cut through the substrate. Further, only one aperture can be provided which is sized to receive one or two fingers. The first and second apertures 26, 28 are preferably spaced and sized to receive the index 36 and pinky 38 fingers of the operator's hand 40. Thus, the middle finger 42 and ring finger 44 engage the passive side of the substrate. The preferred spacing between the first and second apertures is approximately 2 inches between the closest edges of the apertures. This spacing has been found to comfortably fit the index and pinky fingers of the average sized hand. This spacing is also comfortable for operator's with larger hands. Such a user would simply use another combination of the fingers such as the middle finger 42 and the ring finger 44.

To protect the adhesive cleaning side surface 30 the device is preferably provided with a flexible and removable release sheet 46 extending beyond the circumferential edge 34 of the substrate 22. The release liner which is preferably square in shape having dimension of 4.5 inches by 5 inches, protects the adhesive during storage and transport, so that the adhesive is completely free upon removal of the release liner 46 to pick up particulate matter. The dimensions of the device allow it to fit comfortably in a pocket or jacket pocket. Thus, it may be inconspicuously carried in a readily available place for convenient use, and because both the substrate and release liner are flexible the device may be folded and stored in smaller pockets.

Referring specifically to FIG. 2, the index finger 36 is inserted through one of the apertures 28, and the pinky finger 38 is inserted through the other aperture 26. Both fingers are inserted through the apertures from the passive side 32 of the substrate. With the fingers inserted in the apertures, the second finger 42 and third finger 44 and the palm (not shown) engage the passive side of the substrate. The rear or fingernail side of the index and pinky fingers stick to the adhesive surface 30 thereby securely holding the lint removal device while the operator brings it into contact with the garment. When the device is provided with a release liner 46, the release liner is removed before inserting the fingers into the apertures. Thus, the device is held securely without wrapping something around the fingers or inserting the fingers into a mitten.

Figure 3:
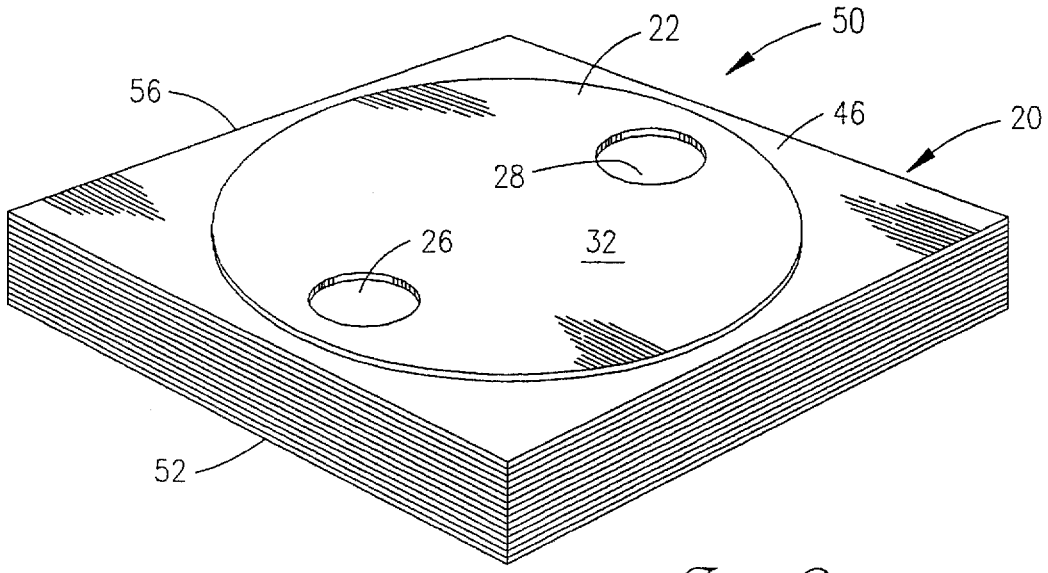
FIG. 3 is a perspective view of a pad of the lint removal devices of FIG. 1.
Figure 4:
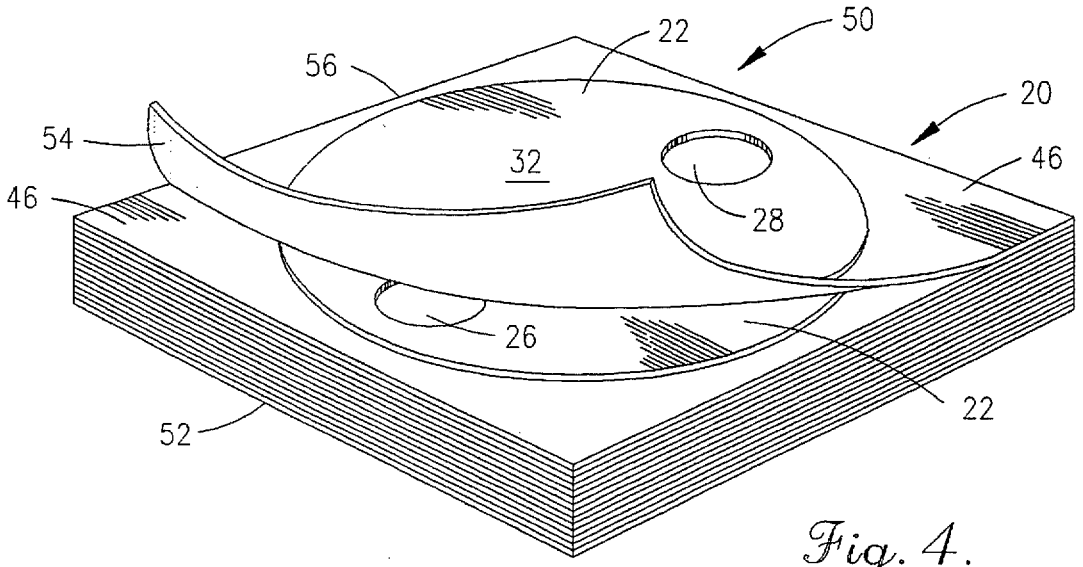
FIG. 4 is a perspective view of the pad of FIG. 3 illustrating removal of one of the lint removal devices.

Referring to FIGS. 3 and 4, the lint removal device 20 of the present invention may be provided in a pad 50 having a plurality of devices. Each of the substrates 22 are separated by a release liner 46, and each of the release liners except for the bottom release liner 52 is provided with an adhesive strip 54 proximate to a top edge 56 of the release liner to attach each of the release liners to an adjacent release liner. In this manner, the devices are neatly organized in a convenient storable pad. Alternatively, the passive side of each device is made slick enough to act as a release liner. In this manner the devices are provided in a pad by reasonably securing the adhesive sides of the devices to the passive sides of the adjacent devices. To simplify removal of a device from the pad, a narrow strip of separate release liner is interposed between each pair of devices at their edges. Thus, the devices are not stuck together at that edge and a single device is quickly separated from the pad by lifting at that edge.

Thus, a lint removal device is disclosed which utilizes an adhesive surface and a pair of apertures to more efficiently remove particulate matter from a cloth article. While preferred embodiments and particular applications of this invention have been shown and described, it is apparent to those skilled in the art that many other modifications and applications of this invention are possible without departing from the inventive concepts herein. For example, the release liner may be provided in two parts. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A disposable hand held cleaning device for cleaning particulate matter from articles of cloth, the device comprising:

a thin and flexible substrate having an edge, a cleaning side with a cleaning side surface capable of removing the particulate matter, and having a passive side opposite the cleaning side for engaging a hand of an operator; and a substantially circular aperture through the substrate sized to receive at least one finger of the operator for conveniently holding the device with the hand while removing the particulate matter.

2. The device according to claim 1 wherein the cleaning side surface comprises an adhesive, and at least one finger of the operator sticks to the adhesive when inserted through the aperture.

3. The device according to claim 1 wherein the cleaning side surface comprises an adhesive.

4. The device according to claim 3 wherein the aperture comprises a substantially circular opening sized to receive a finger of the operator, and the adhesive being adherable to the finger of the operator to hold the device on the hand of the operator when the finger of the operator is inserted through the aperture.

5. The device according to claim 4 further comprising a second aperture through the substrate sized to receive another finger of the operator, and the adhesive being adherable to the other finger of the operator to hold the device on the hand of the operator when the other finger of the operator is inserted through the aperture.

6. The device according to claim 1 further comprising a second aperture through the substrate sized to receive a finger of the operator.

7. The device according to claim 6 wherein the second aperture is located substantially opposite the aperture.

8. The device according to claim 6 wherein the second aperture is spaced approximately 2 inches from the aperture.

9. The device according to claim 1 further comprising a removable release sheet covering and protecting the cleaning side prior to use.

10. The device according to claim 9 wherein the release sheet extends beyond the edge of the substrate.

11. The device according to claim 9 further comprising an adhesive strip applied to the release liner for connecting the release liner to other release liners to form a pad of the devices.

12. The device according to claim 9 wherein the release sheet comprises a substantially square shape, and the substrate is substantially circular.

13. A pad of disposable hand held cleaning devices for cleaning particulate matter from articles of cloth, the pad comprising:

a plurality of thin and flexible substrates, each substrate including:

a circumferential edge, a cleaning side with an adhesive cleaning side surface capable of removing the particulate matter, a passive side opposite the cleaning side for engaging a hand of an operator, a first aperture through the substrate sized to receive a finger of the operator for conveniently holding the device while removing the particulate matter, and a second aperture through the substrate substantially opposite the first aperture and sized to receive another finger of the operator for conveniently holding the device while removing the particulate matter; and a plurality of release liners separating the substrates and covering the adhesive cleaning side surfaces of the substrates and having adhesive strips for attachment to adjacent release liners.

14. A method for removing particulate matter from an article of clothing with a lint removal device including a thin and flexible substrate having: a cleaning side with an adhesive cleaning side surface capable of removing the particulate matter, a passive side opposite the cleaning side, a first aperture through the substrate sized to receive a first finger of the operator, and a second aperture through the substrate substantially opposite the first aperture and sized to receive a second finger of the operator, the method comprising:

inserting the first finger into the first aperture from the passive side so the first finger extends from the cleaning side surface to the passive side surface of the substrate;

inserting the second finger through the second aperture from the passive side so the second finger extends from the cleaning side surface to the passive side surface of the substrate; and contacting the article of clothing to be cleaned with the adhesive surface.

15. The method according to claim 14 wherein the step of inserting the first finger into the first aperture from the passive side comprises inserting an index finger into the first aperture, and the step of inserting the second finger through the second aperture from the passive side comprises inserting a pinky finger through the second aperture.

16. The method according to claim 14 further comprising sticking the adhesive surface to the first finger and the second finger.

17. The method according to claim 14 further comprising removing a release liner from the adhesive cleaning side surface of the substrate.

18. A disposable band held cleaning device for cleaning particulate matter from articles of cloth, said device comprising:

a thin and flexible substrate having an edge, a cleaning side with a cleaning side surface capable of removing the particulate matter, and having a passive side opposite the cleaning side for engaging a hand of an operator; and an aperture, through the substrate, for receiving at least one finger of the operator so at least a portion of the finger extends from the cleaning side surface to the passive side surface of the substrate, wherein said cleaning side surface forms a means for releasably adhering with the portion of the finger extending through the aperture, for conveniently holding the device with the hand while removing the particulate matter.

19. The device according to claim 18 wherein the aperture comprises a substantially circular opening sized to receive a finger of the operator.

* * * * *